US007377786B2

(12) United States Patent
Schilling

(10) Patent No.: US 7,377,786 B2
(45) Date of Patent: May 27, 2008

(54) SLIDING CONTACT ASSEMBLY

(75) Inventor: Harry Schilling, Eichstaett (DE)

(73) Assignee: Schleifring und Apparatebau GmbH, Fuerstenfeldbruck (DE)

( * ) Notice: Subject to any disclaimer, the term of this patent is extended or adjusted under 35 U.S.C. 154(b) by 0 days.

(21) Appl. No.: 11/464,975

(22) Filed: Aug. 16, 2006

(65) Prior Publication Data

US 2007/0032099 A1 Feb. 8, 2007

Related U.S. Application Data

(63) Continuation of application No. PCT/EP2005/001556, filed on Feb. 16, 2005.

(30) Foreign Application Priority Data

Feb. 16, 2004 (DE) ..... 10 2004 007 702

(51) Int. Cl.
*H01R 24/00* (2006.01)

(52) U.S. Cl. ..... 439/22; 439/886

(58) Field of Classification Search ..... 439/22, 439/13, 18, 20, 21, 886
See application file for complete search history.

(56) References Cited

U.S. PATENT DOCUMENTS

| | | | | |
|---|---|---|---|---|
| 4,180,300 | A | 12/1979 | Fort et al. | |
| 4,422,234 | A | 12/1983 | Penn et al. | |
| 5,745,976 | A | 5/1998 | Crockett et al. | |
| 6,517,638 | B1 | 2/2003 | Soupart | |
| 6,669,489 | B1 * | 12/2003 | Dozier et al. | 439/71 |
| 2002/0008966 | A1 * | 1/2002 | Fjelstad et al. | 361/760 |
| 2002/0021947 | A1 | 2/2002 | Hofmann et al. | |
| 2002/0117330 | A1 * | 8/2002 | Eldridge et al. | 174/260 |
| 2003/0151328 | A1 | 8/2003 | Cutsforth et al. | |

FOREIGN PATENT DOCUMENTS

| | | |
|---|---|---|
| DE | 2539091 | 3/1977 |
| DE | 10011999 | 6/2001 |
| DE | 10118351 | 10/2002 |
| DE | 10219958 | 12/2003 |
| WO | 03/072849 | 9/2003 |

OTHER PUBLICATIONS

International Search Report, PCT/US2005/001556, mailed Jun. 6, 2005.

* cited by examiner

*Primary Examiner*—Gary F. Paumen
(74) *Attorney, Agent, or Firm*—Kevin L. Daffer; Daffer McDaniel, LLP

(57) ABSTRACT

A slide track mounting or a contact brush mounting for a sliding contact assembly comprises insulators having a surface structure that is a combined microstructure and nanostructure. Thereby an accumulation of dirt and abraded particles from contact brushes on the insulators is substantially reduced. This allows creep paths to be shortened and periods between maintenance operations for cleaning to be prolonged.

9 Claims, 3 Drawing Sheets

SLIDING CONTACT ASSEMBLY

CROSS REFERENCE TO RELATED APPLICATIONS

This application is a continuation of pending International Application No. PCT/EP2005/001556 filed Feb. 16, 2005, which designates the United States and claims priority to pending German Application DE102004007702.9 filed Feb. 16, 2004.

BACKGROUND OF THE INVENTION

1. Field of the Invention

The invention relates to sliding contact assemblies, in particular slip-rings and also slip-conductors as used for contacting transmission of electric signals or energy between movable parts.

2. Description of the Prior Art

For satisfactory performance of slip-rings and also slip-conductors, hereunder summarily designated by the generic term "sliding-contact assemblies," it is absolutely essential to ensure or maintain an electrical insulation during operation. Sliding-contact assemblies frequently have the problem of contamination which is detrimental to the insulation. Sliding-contact assemblies are frequently of a size that does not permit their being completely encapsulated. Thus, it is hardly possible to completely enclose a slip-conductor having a length of many meters. Similarly, this is possible only with large outlay in the case of slip-rings that frequently are manufactured to have diameters of more than one meter. An ingress of dust and dirt into the sliding-contact assembly must therefore be expected. A far greater problem is usually posed by contamination generated within the sliding-contact assembly itself. Contact brushes are frequently made of conductive material compositions using graphite and metals such as silver, for example. When these contact brushes slide along the slide-tracks during operation, they are continually slightly abraded. The abraded matter passes into the surroundings in the form of a fine dust. This dust possesses a relatively high conductivity, as do the contact brushes, and frequently leads to an impairment of the insulation after a short period of operation.

Thus, when sliding-contact assemblies are designed, the insulating spaces between the slide-tracks and between the contact brushes, as prescribed by the applicable safety regulations, must be maintained. In fact, however, substantially larger insulating spaces, in particular creep paths, are provided in order to maintain the insulation even at given levels of contamination. The demands made on the creep paths then lead to designs requiring high outlay, as disclosed for example in U.S. Pat. No. 5,745,976. Disadvantages of large spaces or barriers of this kind between the slide tracks are the large requirements of space and the high manufacturing cost. At the same time, periods between maintenance operations during which the insulation must be cleaned are usually necessarily short . Cleaning methods of this kind involve relatively large outlay and are time-consuming because the abraded matter usually adheres to the surface very strongly.

In order at least to render difficult an entry of dust through gaps in a closed casing, DE 100 11 999 A suggests providing a dust trap or dust barrier. The surface of this is provided with a specially configured microstructure on which dust adheres particularly well. With this, a migration of the dust into the casing can be prevented effectively. A dust barrier of this kind is unsuitable for use in slip-rings or slip-conductors, because the dust is already being created by brush abrasion inside the assembly itself, and does not first have to migrate into this from the outside. A surface of this kind, on which dust is preferably deposited, would even lead to a more rapid accumulation of matter abraded from the brush, and therewith to an even more rapid deterioration of the insulation.

In DE 10118351 so-called self-cleaning surfaces are disclosed in which the self-cleaning effect, similar to that of the know lotus-effect, is based on water drops running off from the surface and carrying away the dirt lying on the surface. Self-cleaning of this kind only operates on surfaces that regularly come into contact with water. This is the case, for example, with surfaces that are exposed to the weather, and therefore regularly come into contact with rain water. Similarly, self-cleaning would be possible with surfaces that can be washed clean with water. In order for the described self-cleaning effect to operate, it is insufficient for the surfaces to be wiped with a damp cloth. Rather than this, drops must be able to form on the surface. Mechanical cleaning, for example with a damp cloth, may lead to damaging the surface, and also to the dirt particles being pressed into the surface, so that it can no longer be cleaned by the self-cleaning effect. Especially with electrical or electronic instruments and systems in which sliding-contact devices are used, a cleaning under running water is out of the question from the start. Even only damp cleaning, which in any case would not lead to the self-cleaning effect, cannot be performed in many cases because of a sensitivity of the surfaces to corrosion.

In DE 10219958 an electrical sliding contact arrangement is disclosed in a general form. Screen surfaces of electrically conducting material are provided between the slide tracks.

DE 2539091 discloses a sliding contact arrangement in which the slide tracks are mounted on electrically insulating material.

In WO 03/072849 a self-cleaning substrate surface is disclosed which is configured as a double structure having an overlying fine structure of 1-250 nm.

BRIEF SUMMARY OF THE INVENTION

The invention is based on the object of improving a sliding contact assembly, in particular slip-conductors and also slip-rings, so that reliability of insulation may be increased, and periods between maintenance operations lengthened. Furthermore, it is to be made possible to embody sliding contact assemblies having less requirements of space and lower manufacturing costs.

In accordance with the invention, these objects are achieved by a slide track mounting for a sliding contact assembly, comprising: a contact slide track or a plurality of adjacent contact slide tracks; and a slide track support on which the slide track or tracks are mounted via track insulators or optionally directly in case the support is made of an insulating material; wherein surfaces of at least one of track insulators and slide track support are provided at least partly with a double surface structure comprising a rough structure formed by particle-shaped projections on the surface, having a size of 1 μm to 100 μm, and an overlying fine structure formed by at least one of raised portions and recesses having a height of 10 nm to 5 μm.

In accordance with the invention the above-stated objects are also achieved by a contact brush mounting for a sliding contact assembly, comprising: at least one contact brush; and a brush holder on which the contact brush or brushes are mounted via brush insulators or optionally directly in case the brush holder is made of an insulating material; wherein surfaces of at least one of brush insulators and brush holder are provided at least partly with a double surface structure comprising a rough structure and an overlying fine structure as detailed above.

The above-stated objects are also achieved by a method for improving an insulation of a slide track mounting or contact brush mounting in a sliding contact assembly, comprising a step of coating, or configuring, an insulating surface to have a double surface structure comprising a rough structure and an overlying fine structure as detailed above.

BRIEF DESCRIPTION OF THE DRAWINGS

In the following the invention will be described by way of example, without limiting the general inventive concept, on examples of embodiment and with reference to the drawings.

DETAILED DESCRIPTION OF THE INVENTION

Figure 1:
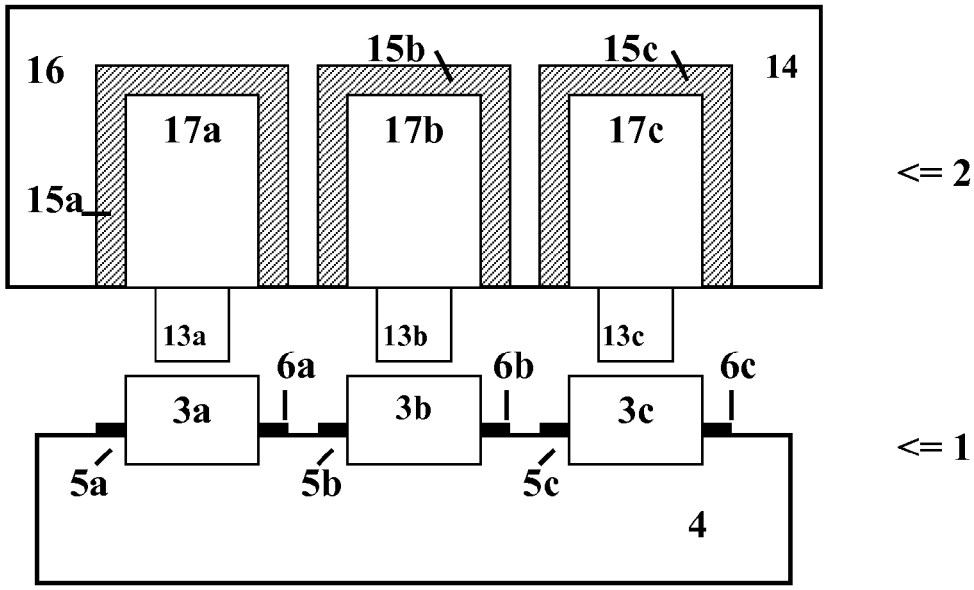
FIG. 1 shows a section of an example of an assembly in accordance with the invention.

FIG. 1 shows a section of an example of an assembly in accordance with the invention. The slide tracks 3*a*, 3*b*, 3*c* are mounted on a support plate 4 of an insulating material. In this example the support plate simultaneously serves also as an accommodating or supporting device, and as an insulator between the individual slide tracks. A coating 5*a*, 5*b*, 5*c* in accordance with the invention is applied around the slide tracks on the support plate. This coating has discontinuous portions 6*a*, 6*b*, 6*c* on which the abraded matter can collect.

Furthermore, a plurality of contact brushes 13*a*, 13*b*, 13*c* are shown which are held and guided by brush holding devices 17*a*, 17*b*, 17*c*. For the sake of clearness, the springs required to maintain contact pressure have not been shown, because they are frequently already incorporated in brush holder devices. The brush holder devices are mounted on a common brush holder plate 14 that may be configured as a printed circuit board, for example. A coating 15*a*, 15*b*, 15*c* in accordance with the invention is applied around the brush holder devices on the brush holder plate. The remaining surface 16 between the coatings may be uncoated, so that the abraded matter can collect here.

Figure 2:
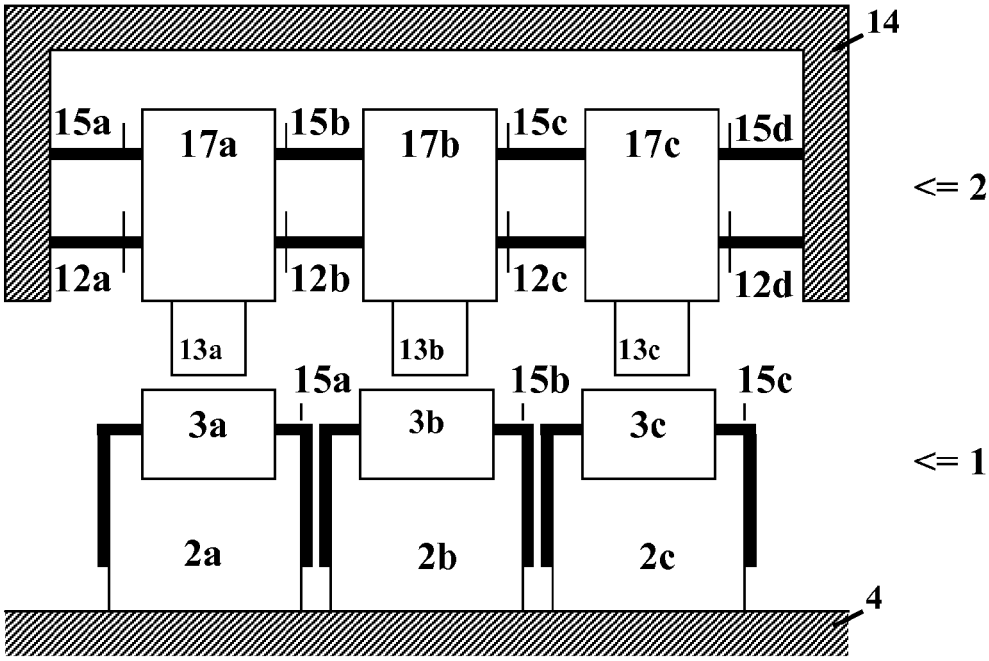
FIG. 2 shows an example of another embodiment of an assembly in accordance with the invention.

FIG. 2 shows an example of another embodiment of an assembly in accordance with the invention. Here the slide tracks 3*a*, 3*b*, 3*c* are mounted on a support plate 4 via additional track insulators 2*a*, 2*b*, 2*c* that are adapted to be supports. Here the support plate may also be of a conducting material, for example a metal. Shown are a plurality of contact brushes 13*a*, 13*b*, 13*c* which are held and guided by brush holder devices 17*a*, 17*b*, 17*c*. These brush holder devices are mounted to the brush holder by means of brush insulators 12*a*, 12*b*, 12*c* so as to be insulated. The brush insulators are provided on their surfaces with a coating 15*a*, 15*b*, 15*c*. Should the brush holding devices be already constructed to be insulating, then it is necessary to apply the coating on the insulating paths of the brush holding devices. Of course, basically different embodiments of the first part 1 and the second part 2, as shown for example in FIGS. 1 and 2, may be combined with each other as desired.

Figure 3:
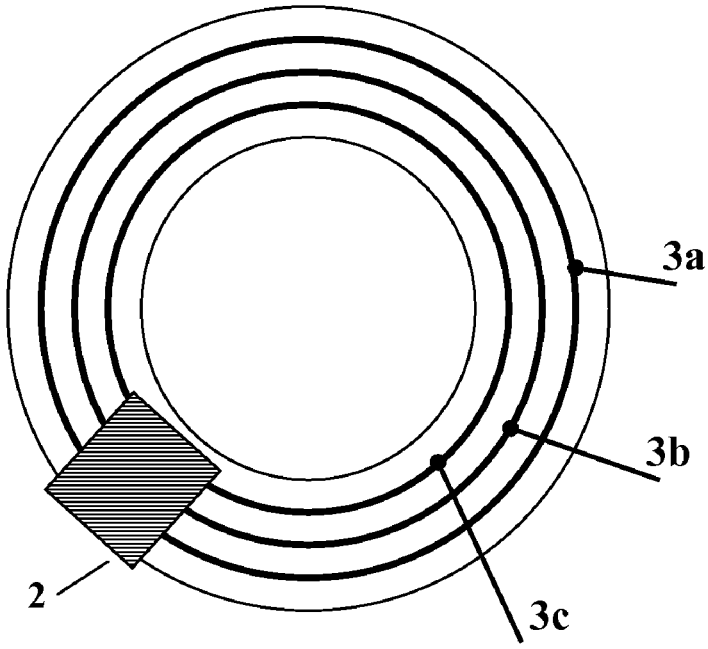
FIG. 3 shows an example of a schematic overall illustration of a sliding contact assembly.

FIG. 3 shows an example of a schematic overall illustration of a sliding contact assembly in the case of a slip-ring. A first part 1 comprises the slide tracks 3*a*, 3*b*, 3*c* and also all other parts needed for their accommodation and attachment, such as a track support 4. Furthermore, a second part 2 is shown that is movable relative to the first part and that particularly comprises the contact brushes 13 and also all components needed for insulation and attachment, for example a brush holder 14.

Figure 4:
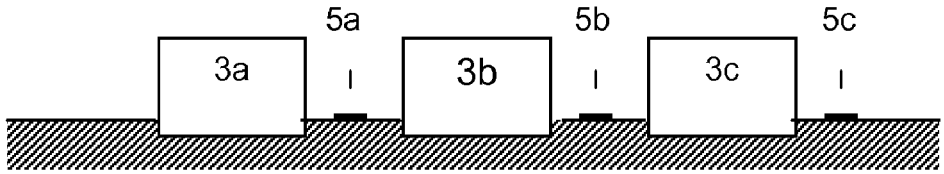
FIG. 4 shows an example of a particularly simple arrangement of a first part.

FIG. 4 shows an example of a particularly simple arrangement of a first part. In this, the respective coatings 5*a*, 5*b*, 5*c* are applied in a strip-shape between the slide tracks 3*a*, 3*b*, 3*c*. The regions between the coatings and the slide tracks here serve as depositories for abraded matter from the brush.

Figure 5:
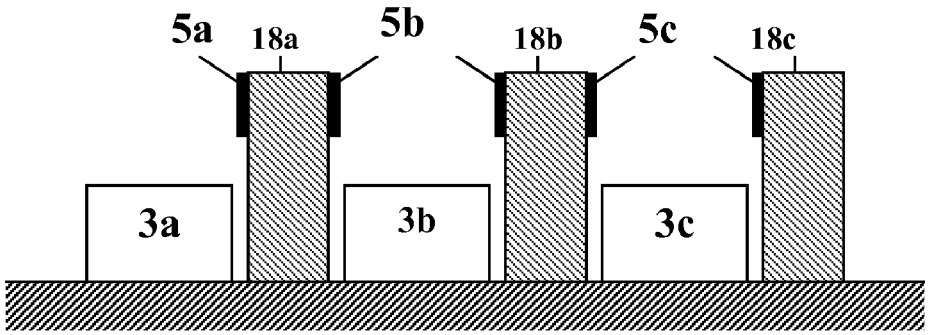
FIG. 5 shows an example of a particularly space-saving arrangement of a first part.

FIG. 5 shows an example of a particularly space-saving arrangement of a first part. Here additional barriers 18*a*, 18*b*, 18*c* are disposed between the slide tracks in order to lengthen the creep paths. A coating 5*a*, 5*b*, 5*c* in accordance with the invention has been applied to the barriers, for example. The coating may be applied optionally laterally, on the upper side, or also on the entire barrier.

Figure 6:
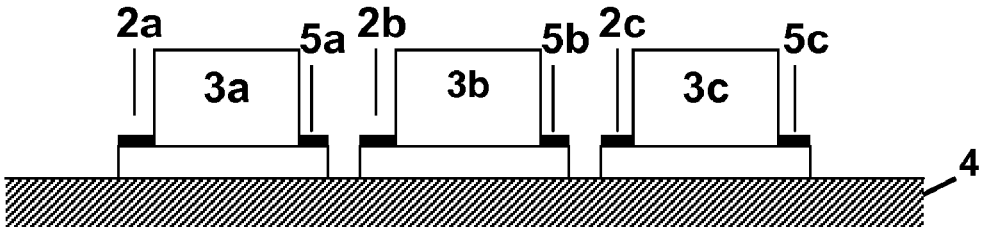
FIG. 6 shows an example of an embodiment of the invention in which the track insulators are configured to be thin films.

FIG. 6 shows an arrangement in which the track insulators 2*a*, 2*b*, 2*c* are formed by means of thin films, for example by foils or varnish layers. In order to achieve a sufficient creep path, the thin layers must extend to beyond the width of the slide tracks. This projecting creep path is preferably provided with coatings 5*a*, 5*b*, 5*c*. Of course, also various different embodiments as shown here may be combined with each other in an arrangement.

The invention comprises components of a sliding contact assembly having a first part 1 comprising at least one slide track 3*a*, 3*b*, 3*c*, and also a second part 2 comprising at least one contact brush 13*a*, 13*b*, 13*c*. At least one or a plurality of slide tracks 3*a*, 3*b*, 3*c* are mounted on a support 4 to be insulated by a track insulation 2*a*, 2*b*, 2*c*. A support of this kind may consist optionally of metal or insulating materials, such as plastics for example. It need not be an independent slip-ring support, and may also be a component part of a machine or a bearing, such as a bearing ring, for example. It is essential to the invention that at least one slide track be insulated from the support by means of at least one track insulator 2*a*, 2*b*, 2*c*. In the case of a conducting support, for example of metal, a track insulation of this kind may be provided by accommodating or supporting devices. Similarly, the track insulation may be formed by thin films, such as foils, varnishes, ceramic layers or oxide layers, for example. Designs are also known in which the track insulation is provided by the plastics support by itself.

Furthermore, at least one or a plurality of contact brushes 13*a*, 13*b*, 13*c* are mounted on a brush holder 14 to be insulated by brush insulators 12*a*, 12*b*, 12*c*, 12*d*. Here too, the brush insulators may be configured accordingly, as in the case of the previously described track insulators or the track insulation. It is also essential for at least one contact brush to be mounted in an insulated manner. The term "contact brush" comprises all objects used for contacting the slide-tracks. These may be, for example, the usually employed silver-graphite brushes, copper brushes, silver-strip brushes, or even gold spring-wire brushes.

Now in accordance with the invention, at least one track insulator or brush insulator is provided at least partially with a specific coating on at least one surface in order to reduce or prevent deposition of matter abraded from the brush and other contamination on the track insulators or the insulation of slide tracks. This coating has a double structure with a rough structure (microstructure) between 1 μm and 100 μm, preferably between 10 μm and 50 μm, and an overlying fine structure (nanostructure) of 10 nm to 5 μm, preferably from 20 nm to 1 μm. The microstructure is preferably formed by particles fixed on the surface, having a size of less than 50 μm. Their size is preferred to be less than 35 μm, and especially preferred to be less than 20 μm. These particles preferably have a rugged structure with raised portions and/or recessed portions in a nanometer (nm) region. These are preferred to have a height of 20 nm to 500 nm, and especially preferred to have a height of 50 nm to 200 nm. The distance between raised portions or recessed portions that are preferably formed as hollow spaces, pores, furrows, tips and/or spikes preferably amounts to less than 500 nm, and more preferably to less than 200 nm. The coated surfaces have the structure-forming particles on the surface preferably with a spacing of 0 to 10 particle diameters, in particular with a spacing of 0 to 3, and most preferred with a spacing of one to two particle diameters.

Coatings of this kind were originally conceived to be so-called self-cleaning surfaces from which water drops run off and carry away accumulated dirt. In tests however, the surprising effect was observed that surfaces of this kind already substantially prevent an accumulation of finest dirt particles, as formed by brush abrasion for example. Thus, "washing" of the surface with drops of water that run off therefrom, as with the Lotus effect, is not necessary. This preventive effect is further improved by streams of air or gas. Particularly with systems such as sliding contact devices in which the components move relative to each other during operation, streams of air of this kind are already caused by the movement. The effect is further increased by stronger air streams, as can be caused, for example, by enforced ventilation.

Now with this invention, an accumulation of matter abraded from brushes can be prevented or at least reduced. Thus, an impairment of the insulation by brush abrasion is also substantially less. Thereby periods between maintenance operations of the device may be prolonged.

The invention generally relates to the configuration of a surface. A surface in accordance with the invention may be obtained preferably by coating, or also by differently configuring the surface structure, such as for example by etching. In the following, for reasons of clarity reference will be made only to the term "coating" which is intended to include also other structuring of the surface.

Furthermore, the invention comprises slide-track mountings as employed in a previously illustrated sliding contact assembly. These slide-track mountings comprise a first part 1 with one or a plurality of slide tracks 3*a*, 3*b*, 3*c* mounted on a support 4 to be insulated by track insulators 2*a*, 2*b*, 2*c*, or optionally directly to the support 4 in the case of a support of an insulating material. The insulation and particularly the surface of the creep path of the insulation is at least partially provided with a coating to produce the above-described double structure.

Similarly, the invention comprises brush mountings as used in a previously illustrated sliding contact assembly. These brush mountings comprise a second part 2 with one or a plurality of contact brushes 13*a*, 13*b*, 13*c* mounted on at least one brush holder 14 to be insulated by brush insulators 12*a*, 12*b*, 12*c*, 12*d*, or optionally directly to the brush holder 14 in the case of a brush holder 14 of an insulating material.

In an especially advantageous embodiment of the invention, the coating is applied around slide tracks or brush holder devices preferably in the form of a closed surface. With this, the coating encloses slide tracks or brush holder devices. These are situated like an island within the surface enclosed by the coating.

In another advantageous embodiment of the invention the coating or surface structure is adapted to have antistatic properties, or is covered by a thin film having antistatic properties. Dust is frequently attracted by static charging of the surface. With a surface rendered antistatic, for example so that the surface has at least small conductivity, this additional attractive effect can be reduced.

In another embodiment of the invention, further surfaces 6*a*, 6*b*, 6*c* without a coating are provided between the surfaces that have a coating 5*a*, 5*b*, 5*c* or 15*a*, 15*b*, 15*c*, or the coating is discontinuous, being interrupted by uncoated surfaces. These surfaces are preferably disposed so that they form no connecting paths between conducting portions of different potentials. No abraded matter from brushes can adhere to the coated surfaces. Rather than this, it will migrate along the coated surfaces until it reaches an uncoated surface on which it can settle. The uncoated regions at the edge of the coated surfaces thus serve as collecting surfaces for the matter abraded from the brushes. With this the matter abraded from brushes can be retained within predefined regions in which it will not impair the insulation. In addition, the collecting surfaces may be disposed so that they are easily accessible for cleaning. If, for example, regions of difficult access are provided with the coating, then they need no longer be cleaned during maintenance. These surfaces may also be configured to be collecting containers of high cubical content. The abraded matter for brushes may be removed from the easily accessible uncoated surfaces, for example by means of a vacuum cleaner.

Another embodiment of the invention consists of the discontinuous portions 6*a*, 6*b*, 6*c* of the coated surfaces having at least one microcrystalline-structured microstructure, the surface of which has raised portions and recesses within a range of 5 μm to 100 μm at a spacing from each other in a range of 5 μm to 200 μm.

A computer tomograph in accordance with the invention comprises at least one sliding contact assembly, in particular a slip-ring, having at least one of a slide track mounting and a contact brush mounting in accordance with the invention.

In another advantageous embodiment, further components or componentry of a computer tomograph have on their surface an artificial microcrystalline-structured microstructure.

The invention claimed is:

1. Slide track mounting for a sliding contact assembly, comprising:

a contact slide track or a plurality of adjacent contact slide tracks;

a slide track support on which the slide track or tracks are mounted via track insulators or optionally directly in case the support is made of an insulating material; and wherein surfaces of at least one of track insulators and slide track support are provided at least partly with a double surface structure comprising a rough structure formed by particle-shaped projections on the surface, having a size of 1 μm to 100 μm, and an overlying fine structure formed by at least one of raised portions and recesses having a height of 10 nm to 5 μm.

2. Slide track mounting according to claim 1, wherein the double surface structure is formed by a coating.

3. Slide track mounting according to claim 1, wherein the double surface structure comprises a rough structure having a size of 10 μm to 50 μm, and an overlying fine structure having a height of 20 nm to 1 μm.

4. Slide track mounting according to claim 1, wherein the double surface structure is at least partly provided with antistatic properties, or is coated with a thin film having antistatic properties.

5. Slide track mounting according to claim 1, wherein the double surface structure is applied around slide tracks in the form of a closed surface.

6. Slide track mounting according to claim 1, wherein the double surface structure is provided with discontinuous portions.

7. Slide track mounting according to claim 6, wherein the discontinuous portions at least partly have an artificial microcrystalline-structured microstructure, surfaces of which have raised portions and recessed portions within a range of 5 μm to 100 μm at a spacing from each other in a range of 5 μm to 200 μm.

8. Computer tomograph with a slip-ring sliding contact assembly, comprising:

a contact slide track or a plurality of adjacent contact slide tracks;

a slide track support on which the slide track or tracks are mounted via track insulators or optionally directly in case the support is made of an insulating material; and wherein surfaces of at least one of track insulators and slide track support are provided at least partly with a double surface structure comprising a rough structure formed by particle-sized projections on the surface, having a size of 1 μm to 100 μm, and an overlying fine structure formed by at least one of raised portions and recesses having a height of 10 nm to 5 μm.

9. Computer tomograph according to claim 8, wherein a surface of at least one other component has an artificial microcrystalline-structured microstructure.

* * * * *